US011261711B2

(12) United States Patent
Lane

(10) Patent No.: US 11,261,711 B2
(45) Date of Patent: Mar. 1, 2022

(54) CRIMPED ATTACHMENT OF END FITTING TO CHARGE TUBE

(71) Applicant: Hunting Titan, Inc., Pampa, TX (US)

(72) Inventor: Andy Lane, Lubbock, TX (US)

(73) Assignee: Hunting Titan, Inc., Pampa, TX (US)

( * ) Notice: Subject to any disclaimer, the term of this patent is extended or adjusted under 35 U.S.C. 154(b) by 328 days.

(21) Appl. No.: 16/500,781

(22) PCT Filed: Apr. 13, 2018

(86) PCT No.: PCT/US2018/027571
§ 371 (c)(1),
(2) Date: Oct. 3, 2019

(87) PCT Pub. No.: WO2018/191668
PCT Pub. Date: Oct. 18, 2018

(65) Prior Publication Data

US 2021/0355795 A1 Nov. 18, 2021

Related U.S. Application Data

(60) Provisional application No. 62/484,936, filed on Apr. 13, 2017.

(51) Int. Cl.
*E21B 43/117* (2006.01)
*E21B 43/119* (2006.01)
(Continued)

(52) U.S. Cl.
CPC ..... *E21B 43/117* (2013.01); *E21B 29/02* (2013.01); *E21B 43/11* (2013.01); *E21B 43/116* (2013.01); *E21B 43/119* (2013.01)

(58) Field of Classification Search
CPC ..... E21B 29/02; E21B 43/11; E21B 42/116; E21B 43/117; E21B 43/119
See application file for complete search history.

(56) References Cited

U.S. PATENT DOCUMENTS 3,040,659 A 6/1962 McCullough
3,811,367 A 5/1974 Bimba
(Continued)

FOREIGN PATENT DOCUMENTS

WO 2015179787 A1 11/2015
WO 2017014741 A1 1/2017

OTHER PUBLICATIONS

Notification of Transmittal of the International Search Report and the Written Opinion of the International Searching Authority, PCT Application No. PCT/US18/27571, dated Jul. 6, 2018, 10 pages.
(Continued)

*Primary Examiner* — Yong-Suk (Philip) Ro
(74) *Attorney, Agent, or Firm* — Christopher McKeon; Jason Saunders; Arnold & Saunders, LLP

(57) ABSTRACT

A charge tube for shaped charges into a perforating gun having a hollow cylindrical body with a first end and a second end, one or more cutouts adapted to fit a shaped charge, one or more apex cutouts, located 180 degrees about the center axis of the hollow cylindrical body from the at least one or more cutouts, adapted to fit the apex end of a shaped charge, and at least one set of parallel, partially circumferential, slot cuts proximate to the first end of the cylindrical body.

29 Claims, 6 Drawing Sheets

(51) Int. Cl.

| | |
|---|---|
| ***E21B 43/11*** | (2006.01) |
| ***E21B 43/116*** | (2006.01) |
| ***E21B 29/02*** | (2006.01) |

(56) References Cited

U.S. PATENT DOCUMENTS

| | | | | |
|---|---|---|---|---|
| 4,598,776 | A | 7/1986 | Stout | |
| 5,797,464 | A * | 8/1998 | Pratt | E21B 43/117 175/4.6 |
| 6,298,915 | B1 * | 10/2001 | George | E21B 43/119 166/255.2 |
| 10,273,788 | B2 * | 4/2019 | Bradley | F42B 5/035 |
| 10,746,004 | B2 * | 8/2020 | Yang | E21B 43/119 |
| 2006/0027397 | A1 | 2/2006 | Scott | |
| 2010/0089643 | A1 * | 4/2010 | Vidal | E21B 43/117 175/2 |
| 2015/0330192 | A1 * | 11/2015 | Rogman | F42C 15/34 166/297 |
| 2018/0112500 | A1 * | 4/2018 | Collins | E21B 43/11855 |
| 2018/0297102 | A1 | 10/2018 | Quick | |

OTHER PUBLICATIONS

Communication with Supplementary European Search Report, European Application No. EP18784114, dated Dec. 2, 2020, 8 pages.

* cited by examiner

CRIMPED ATTACHMENT OF END FITTING TO CHARGE TUBE

RELATED APPLICATION

This application claims priority to U.S. Provisional Application No. 62/484,936, filed Apr. 13, 2017.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused explosive output. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates the liner metal is compressed into a super-heated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, a detonator at one end of the perforating gun can detonate all of the perforating charges in the gun and continue a ballistic transfer to the opposite end of the gun. In this fashion, numerous perforating guns can be connected end to end with a single detonator detonating all of them.

The detonating cord is typically detonated by a detonator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Within a typical gun tube is a charge holder designed to hold the shaped charges. Charge holders can be formed as tubes, strips, or chains. The charge holder will contain cutouts called charge holes to house the shaped charges.

SUMMARY OF EXAMPLE EMBODIMENTS

An example embodiment may include a charge tube for loading shaped charges into a perforating gun having a hollow cylindrical body with a first end and a second end, one or more cutouts adapted to fit a shaped charge, one or more apex cutouts adapted, located 180 degrees about the center axis of the hollow cylindrical body from the at least one or more cutouts, adapted to fit the apex end of a shaped charge, and at least one set of parallel, partially circumferential, slot cuts proximate to the first end of the cylindrical body, wherein the area of the cylindrical body in between the two parallel slot cuts forms a slotted tab that may be crimped against an end fitting.

A variation of an example embodiment may include at least one set of parallel, partially circumferential, slot cuts proximate to the second end of the cylindrical body. It may include a second set of parallel, partially circumferential, slot cuts proximate to the first end of the cylindrical body and located 180 degrees opposite about the center axis of the cylindrical body from the first set of parallel slot cuts. It may include a tab protruding axially from the first end of the cylindrical body, wherein the tab locates the charge tube relative to an end fitting. It may include a tab protruding axially from the second end of the cylindrical body, wherein the tab locates the charge tube relative to an end fitting. The slotted tab may be crimped into a radial groove located on an end fitting. It may include at least one alignment slot located adjacent to each of the at least one or more shaped charge cutouts. The slotted tab is crimped using a crimping die.

An example embodiment may include a perforating gun system including a perforating gun body containing a charge tube for loading shaped charges into a perforating gun including a hollow cylindrical body with a first end and a second end, one or more cutouts adapted to fit a shaped charge, one or more apex cutouts adapted, located 180 degrees about the center axis of the hollow cylindrical body from the at least one or more cutouts, adapted to fit the apex end of a shaped charge, at least one set of parallel, partially circumferential, slot cuts proximate to the first end of the cylindrical body, wherein the area of the cylindrical body in between the two parallel slot cuts forms a first slotted tab that may be crimped against an end fitting, and at least one set of parallel, partially circumferential, slot cuts proximate to the second end of the cylindrical body, wherein the area of the cylindrical body in between the two parallel slot cuts forms a second slotted tab that may be crimped against an end fitting, one or more shaped charges located in each cutout of the charge tube, a first end fitting coupled to the first end of the charge tube, and a second end fitting coupled to the second end of the charge tube.

A variation of the example embodiment may include at least one set of parallel, partially circumferential, slot cuts proximate to the second end of the cylindrical body. It may include a third set of parallel, partially circumferential, slot cuts proximate to the first end of the cylindrical body and located 180 degrees opposite about the center axis of the cylindrical body from the first set of parallel slot cuts. It may include a fourth set of parallel, partially circumferential, slot cuts proximate to the second end of the cylindrical body and located 180 degrees opposite about the center axis of the cylindrical body from the second set of parallel slot cuts. It may include a first tab protruding axially from the first end of the cylindrical body, wherein the tab locates the charge tube relative to the first end fitting. It may include a tab protruding axially from the second end of the cylindrical body, wherein the tab locates the charge tube relative to the second end fitting. The first slotted tab may be crimped into a radial groove located on the first end fitting. The second slotted tab may be crimped into a radial groove located on the second end fitting. It may include at least one alignment slot located adjacent to each of the at least one or more shaped charge cutouts. Slotted tabs are crimped using a crimping die.

An example embodiment may include a method for coupling a cylindrical charge tube having a first end and a second end to an end fitting comprising cutting two parallel radial cuts on a portion of a charge tube proximate to the first end of a charge tube to form a first slotted tab, coupling a first end fitting to the first end of the charge tube, and crimping the first slotted tab into the first end fitting. It may include cutting two parallel radial cuts on a portion of a charge tube proximate to the second end of a charge tube to form a second slotted tab. It may include coupling a second end fitting to the second end of the charge tube. It may include crimping the second slotted tab into the second end fitting. It may include cutting two parallel radial cuts on a portion of a charge tube proximate to the first end of the charge tube and 180 degrees opposite on the charge tube from the first slotted tab to form a third slotted tab. It may include crimping the third slotted tab into the first end fitting. It may include cutting two parallel radial cuts on a portion of a charge tube proximate to the second end of the charge tube and 180 degrees opposite on the charge tube from the second slotted tab to form a fourth slotted tab. It may include crimping the fourth slotted tab into the second end fitting. It may include aligning the charge tube with the first end fitting using a protruding tab extending axially from the first end of the charge tube. It may include aligning the charge tube with a second end fitting using a protruding tab extending axially from the second end of the charge tube. It may include installing at least one shaped charge into the charge tube. It may include installing the charge tube into a perforating gun. It may include coupling the perforating gun into a tool string. It may include positioning the tool string at a predetermined location in a wellbore. It may include detonating the at least one shaped charge installed in the charge tube.

An example embodiment may include a charge tube for loading shaped charges into a perforating gun comprising a hollow cylindrical body with a first end and a second end, one or more cutouts adapted to fit a shaped charge, one or more apex cutouts adapted, located 180 degrees about the center axis of the hollow cylindrical body from the at least one or more cutouts, adapted to fit the apex end of a shaped charge, and at least one slot cut proximate to the first end of the cylindrical body, wherein the area of the cylindrical body in between the two parallel slot cuts forms a slotted tab that may be crimped against an end fitting. The at least one slot cut may be a set of two parallel, partially circumferential, slot cuts. The at least one slot cut may be a set of two perpendicular, slot cuts with a thru hole at the intersection. The at least one slot cut may be a single, partially circumferential, slot cut with a thru hole at its center. The example may include at least one, partially circumferential, slot cut proximate to the second end of the cylindrical body. It may include a second, partially circumferential, slot cut proximate to the first end of the cylindrical body and located 180 degrees opposite about the center axis of the cylindrical body from the first slot cut. It may include a tab protruding axially from the first end of the cylindrical body, wherein the tab locates the charge tube relative to an end fitting. It may include a tab protruding axially from the second end of the cylindrical body, wherein the tab locates the charge tube relative to an end fitting. The slotted tab may be crimped into a radial groove located on an end fitting. It may include at least one alignment slot located adjacent to each of the at least one or more shaped charge cutouts. The slotted tab may be crimped using a crimping die.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Figure 1A:
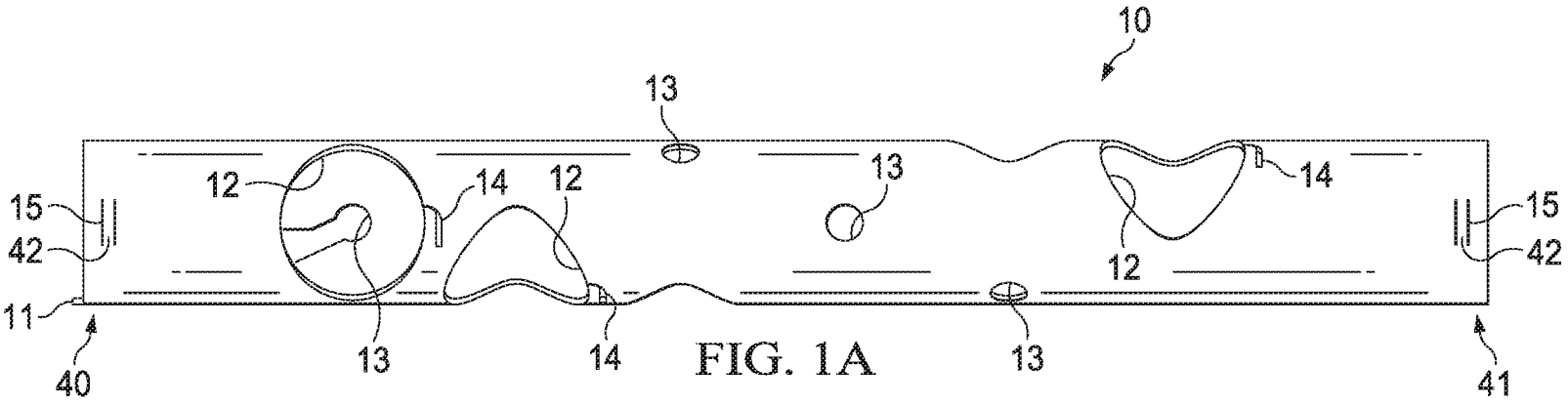
FIG. 1A is a side view of a charge tube having slotted ends.

An example embodiment is shown in FIG. 1A where a charge tube 10 is depicted as being a hollow cylindrical in shape, with a first end 40 and a second end 41, and having shaped charge cutouts 12. These shaped charge cutouts 12 allow shaped charges to be installed within the charge tube 10. Each shaped charge cutout 12 has a corresponding shaped charge apex cutout 13 located 180 degrees opposite about the center axis of the charge tube. The shaped charge apex cutouts 13 allow the apex end of the shaped charge to protrude out of the charge tube. Those apex ends generally are coupled to detonating cord when assembled into a perforating gun. The charge tube 10 has alignment tabs 11 located at the first end 40. Each shaped charge cutout 12 also, in this example, has an associated alignment slot 14 for shaped charges with alignment tabs to locate and lock into place when installed.

Figure 1B:
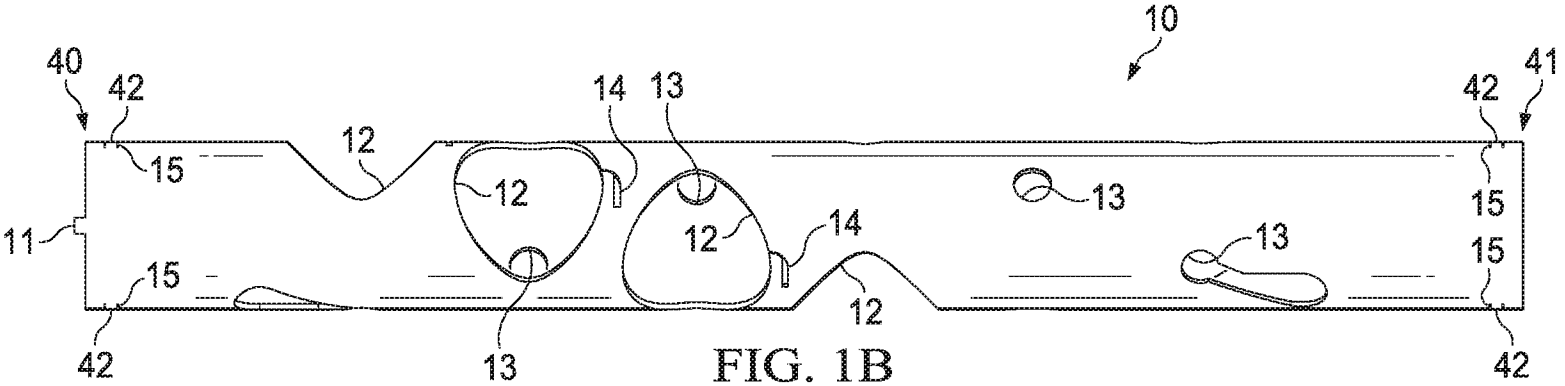
FIG. 1B is a side view of a charge tube having slotted ends rotated about the center axis 90 degrees compared to FIG. 1A.

The first and second ends of the charge tube 10 have slots cuts 15 located proximate to each end. The slot cuts 15 are two parallel cuts into the outer surface of the charge tub 10, and parallel to the first end and the second end. Each pair of slot cuts 15 shown in FIG. 1A has an associated pair of slot cuts 15 located 180 degrees apart on the charge tube 10 as shown in FIG. 1B. An end cap is generally coupled to both the first end and the second end of the charge tube 10. The area in between the slot cuts 15 forms a slotted tab 42 that can be crimped against an end fitting.

Figure 2:
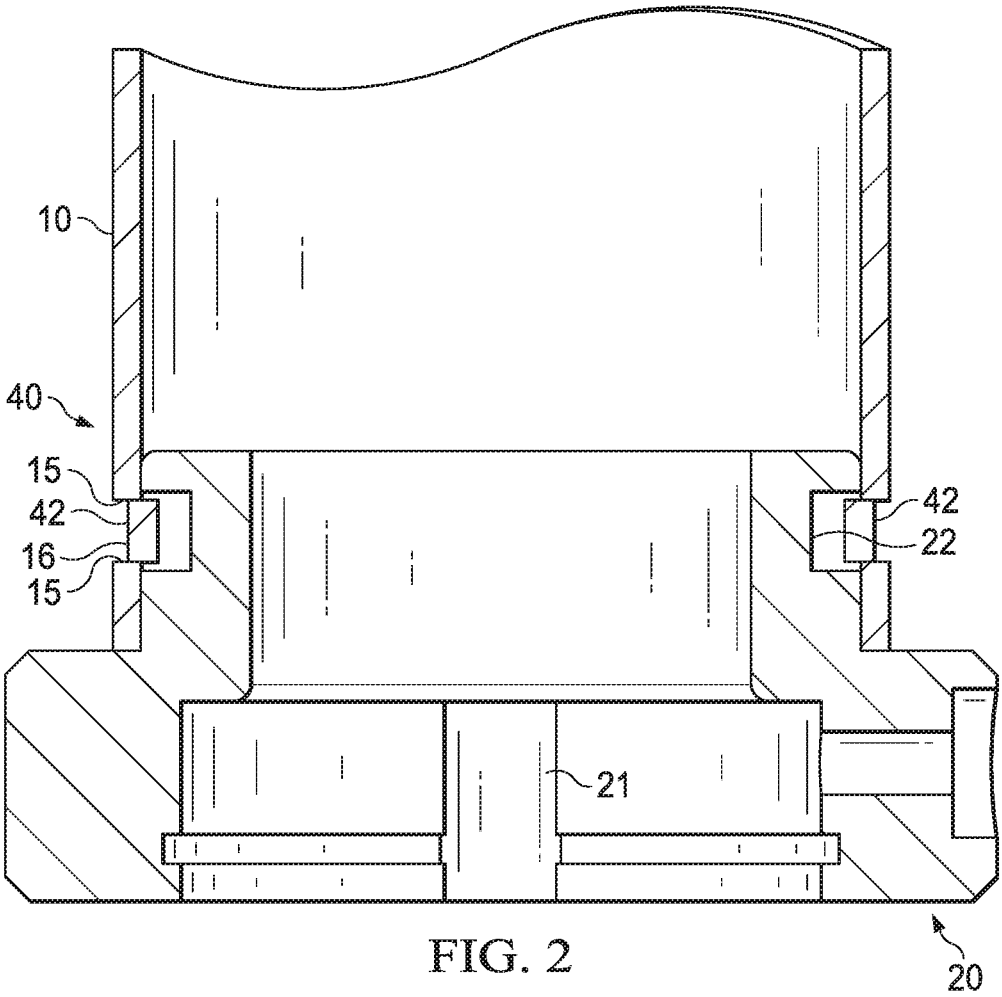
FIG. 2 is a close up cross-sectional side view of a slotted end of a charge tube.

A close up of the first end 40 of the charge tube 10 is shown in FIG. 2. In this example an end fitting 20 has been coupled to the first end 40 of the charge tube 10. The slotted tabs 42, which are formed from the slotted cuts 15, are pressed into groove 22 to form a crimped end 16. In this example the end fitting 20 has an alignment hole 21 that aligns with the alignment tab 11 shown in FIG. 1A.

Figure 3A:
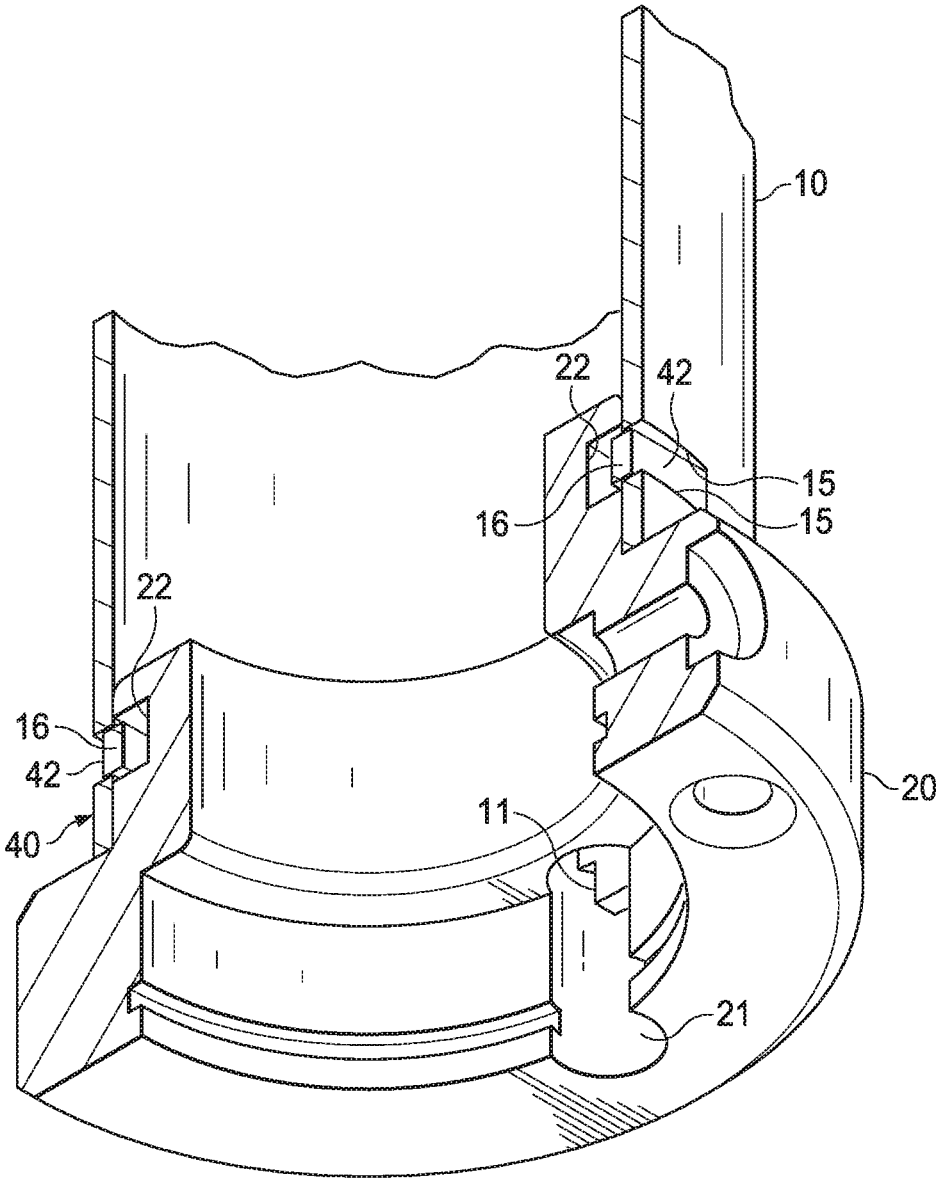
FIG. 3A is a perspective view of a cross-sectioned end of a charge tube.
Figure 3B:
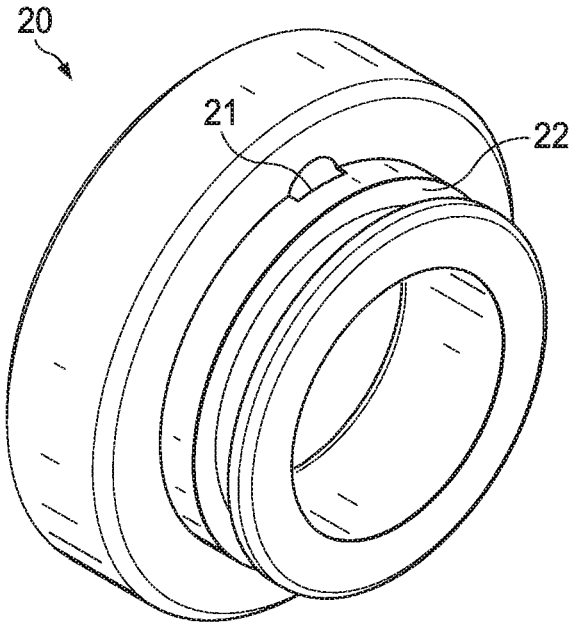
FIG. 3B is a perspective view of an end fitting for a charge tube.
Figure 3C:
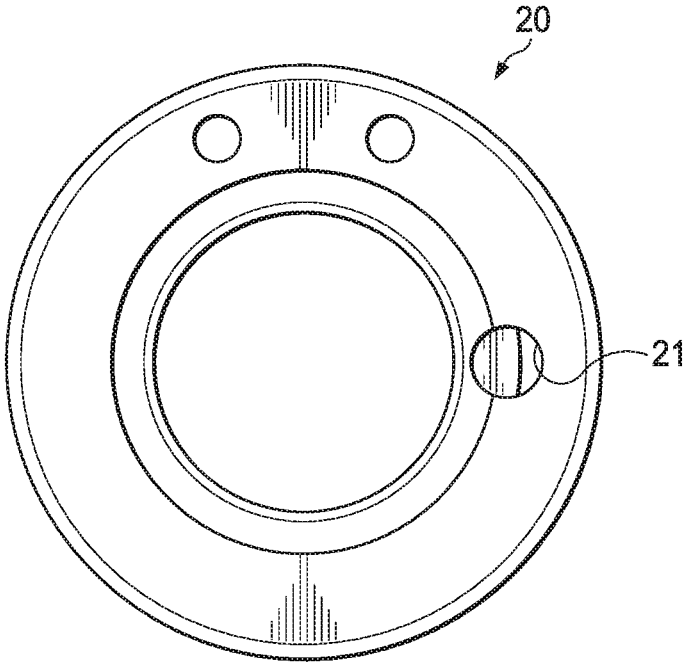
FIG. 3C is a plane view of an end fitting for a charge tube.

Further views of the example charge tube 10 crimped onto end fitting 20 are shown in FIGS. 3A, 3B, and 3C. FIG. 3A shows the first end 40 of the charge tub 10 with slot cuts 15 located on opposite sides, about the center axis, of the first end 40. The area of the charge tube 10 in between the slot cuts 15 forms a slotted tab 42, which is then pressed into the groove 22 of the end fitting 20, to form crimped ends 16. The alignment tab 11 is located in the alignment hole 21 to control the orientation of the end fitting 20 relative to the charge tube 10.

FIGS. 3B and 3C depict the end fitting 20 from different angles. The end fitting 20 has a groove 22 for the slotted tabs 42 to be pressed into to form a crimped end. The end fitting 20 also has alignment holes 21 for locating the alignment tab 11 during installation.

Figure 4:
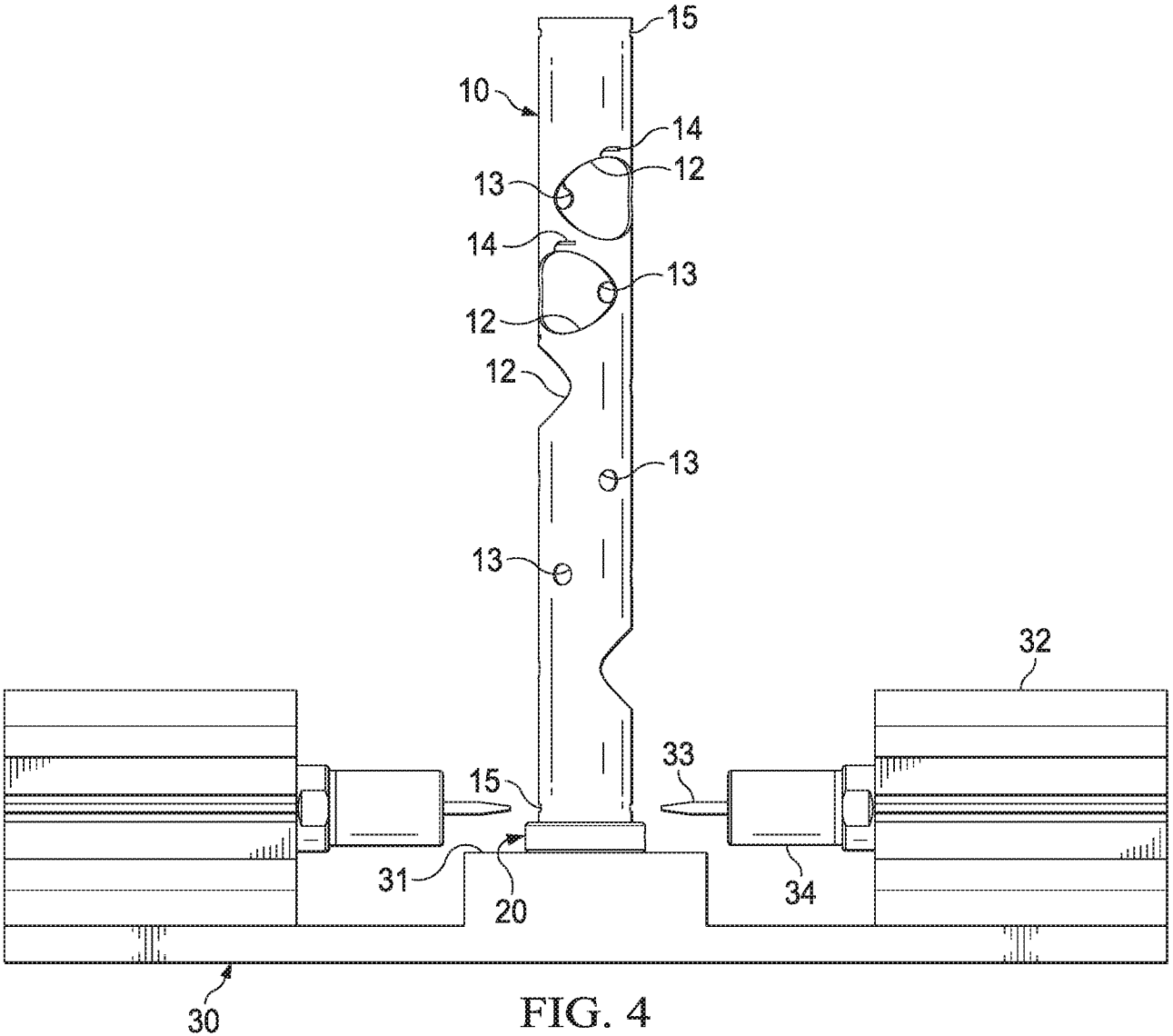
FIG. 4 is a side view of a charge tube and a crimping press.

An example embodiment of how the crimped end is made is depicted in FIG. 4. The charge tube 10 is shown having slotted ends 15, shaped charge cutouts 12, alignment slots 14, and apex end cutouts 13. The charge tube 10 is positioned upright on top of an end fitting 20, located on the base 31 of a crimping press 30. Two crimp dies 33, located opposite of each other, press towards each other, against the slotted ends 15, to crimp the charge tube 10 against the end fitting 20. Hydraulic cylinders 32 provide the force necessary to crimp the end of charge tube 10, which is often composed of metal, such as steel, and requires sufficient force to crimp.

Figure 5B:
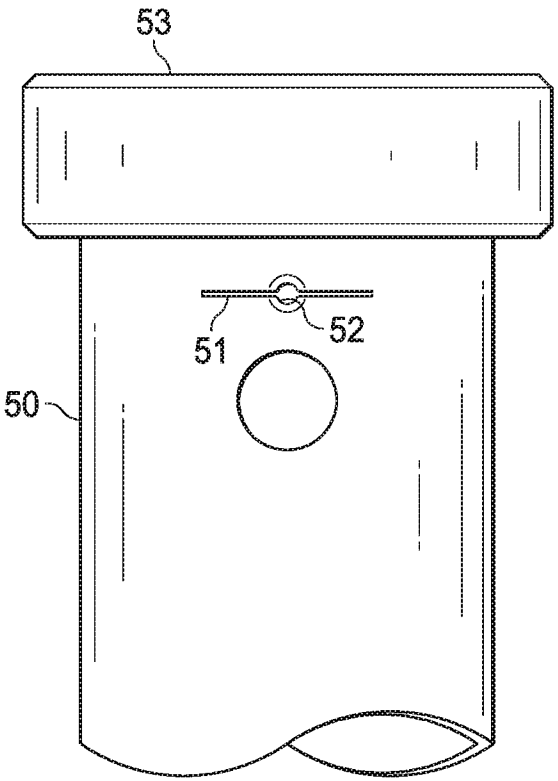
FIG. 5B is a side view of an exampled embodiment of a charge tube crimped onto an end fitting.
Figure 5A:
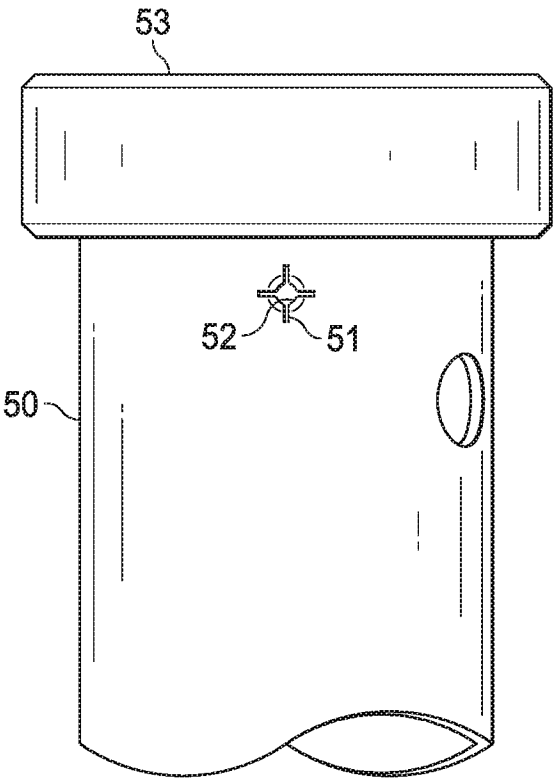
FIG. 5A is a side view of an exampled embodiment of a charge tube crimped onto an end fitting.

FIG. 5A shows a charge tube 50 crimped onto an end fitting 53. In this example the slot cut 51 is cross shaped with a thru hole 52 drilled into the center of the cross. The combination of the slot cut 51 and the thru hole 52 provides the location on the charge tube 50 for crimping for crimping against the end fitting 53. A second slot cut 51 and thru hole 52 may be located 180 degrees opposite of the features shown on the charge tube 50.

FIG. 5B shows a charge tube 50 crimped onto an end fitting 53. In this example the slot cut 51 is a single radial cut a thru hole 52 drilled into the center of the cut. The combination of the slot cut 51 and the thru hole 52 provides the location on the charge tube 50 for crimping against the end fitting 53. A second slot cut 51 and thru hole 52 may be located 180 degrees opposite of the features shown on the charge tube 50.

The crimped end may replace screwed ends that are typically seen in the industry. A crimped end solution provides for an automated process for attaching the charge tube to the end fitting. The time saved aligning and installing a threaded connection allows for increased productivity, especially considering that these charge tubes and end fittings are produced in large numbers. The large increase in production requirements has occurred recently as ever large numbers of perforating guns are being used in perforating long, usually horizontal, wells.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A charge tube for loading shaped charges into a perforating gun comprising:

a hollow cylindrical body with a first end and a second end;

one or more cutouts adapted to fit a shaped charge;

one or more apex cutouts, located 180 degrees about a center axis of the hollow cylindrical body from the at least one or more cutouts, adapted to fit an apex end of a shaped charge; and at least one set of parallel, partially circumferential, slot cuts proximate to the first end of the cylindrical body, wherein an area of the cylindrical body in between two parallel slot cuts forms a slotted tab that is crimped against an end fitting.

2. The apparatus of claim 1, further comprising at least one set of parallel, partially circumferential, slot cuts proximate to the second end of the cylindrical body.

3. The apparatus of claim 1, further comprising a second set of parallel, partially circumferential, slot cuts proximate to the first end of the cylindrical body and located 180 degrees opposite about the center axis of the cylindrical body from the first set of parallel slot cuts.

4. The apparatus of claim 1, further comprising a tab protruding axially from the first end of the cylindrical body, wherein the tab locates the charge tube relative to an end fitting.

5. The apparatus of claim 1, further comprising a tab protruding axially from the second end of the cylindrical body, wherein the tab locates the charge tube relative to an end fitting.

6. The apparatus of claim 1, wherein the slotted tab may be crimped into a radial groove located on an end fitting.

7. The apparatus of claim 1, further comprising at least one alignment slot located adjacent to each of the at least one or more shaped charge cutouts.

8. The apparatus of claim 1, wherein the slotted tab is crimped using a crimping die.

9. A perforating gun system comprising:

a perforating gun body containing a charge tube for loading shaped charges into a perforating gun further comprising:

a hollow cylindrical body with a first end and a second end;

one or more cutouts adapted to fit a shaped charge;

one or more apex cutouts, located 180 degrees about a center axis of the hollow cylindrical body from the at least one or more cutouts, adapted to fit an apex end of a shaped charge;

at least one set of parallel, partially circumferential, slot cuts proximate to the first end of the cylindrical body, wherein an area of the cylindrical body in between two parallel slot cuts forms a first slotted tab that is crimped against an end fitting; and at least one set of parallel, partially circumferential, slot cuts proximate to the second end of the cylindrical body, wherein the area of the cylindrical body in between the two parallel slot cuts forms a second slotted tab that is crimped against an end fitting;

one or more shaped charges located in each cutout of the charge tube;

a first end fitting coupled to the first end of the charge tube; and a second end fitting coupled to the second end of the charge tube.

10. The apparatus of claim 9, further comprising at least one set of parallel, partially circumferential, slot cuts proximate to the second end of the cylindrical body.

11. The apparatus of claim 9, further comprising a third set of parallel, partially circumferential, slot cuts proximate to the first end of the cylindrical body and located 180 degrees opposite about the center axis of the cylindrical body from the first set of parallel slot cuts.

12. The apparatus of claim 9, further comprising a fourth set of parallel, partially circumferential, slot cuts proximate to the second end of the cylindrical body and located 180 degrees opposite about the center axis of the cylindrical body from the second set of parallel slot cuts.

13. The apparatus of claim 9, further comprising a first tab protruding axially from the first end of the cylindrical body, wherein the tab locates the charge tube relative to the first end fitting.

14. The apparatus of claim 13, further comprising a tab protruding axially from the second end of the cylindrical body, wherein the tab locates the charge tube relative to the second end fitting.

15. The apparatus of claim 9, wherein the first slotted tab may be crimped into a radial groove located on the first end fitting.

16. The apparatus of claim 9, wherein the second slotted tab may be crimped into a radial groove located on the second end fitting.

17. The apparatus of claim 9, further comprising at least one alignment slot located adjacent to each of the at least one or more shaped charge cutouts.

18. The apparatus of claim 9, wherein slotted tabs are crimped using a crimping die.

19. A charge tube for loading shaped charges into a perforating gun comprising:

a hollow cylindrical body with a first end and a second end;

one or more cutouts adapted to fit a shaped charge;

one or more apex cutouts, located 180 degrees about a center axis of the hollow cylindrical body from the at least one or more cutouts, adapted to fit an apex end of a shaped charge; and at least one slot cut proximate to the first end of the cylindrical body, wherein an area of the cylindrical body in between two parallel slot cuts forms a slotted tab that is crimped against an end fitting.

20. The apparatus of claim 19 wherein the at least one slot cut is a set of two parallel, partially circumferential, slot cuts.

21. The apparatus of claim 19 wherein the at least one slot cut is a set of two perpendicular slot cuts with a thru hole at the an intersection.

22. The apparatus of claim 19 wherein the at least one slot cut is a single, partially circumferential, slot cut with a thru hole at its center.

23. The apparatus of claim 19, further comprising at least one, partially circumferential, slot cut proximate to the second end of the cylindrical body.

24. The apparatus of claim 19, further comprising a second, partially circumferential, slot cut proximate to the first end of the cylindrical body and located 180 degrees opposite about the center axis of the cylindrical body from the first slot cut.

25. The apparatus of claim 19, further comprising a tab protruding axially from the first end of the cylindrical body, wherein the tab locates the charge tube relative to an end fitting.

26. The apparatus of claim 19, further comprising a tab protruding axially from the second end of the cylindrical body, wherein the tab locates the charge tube relative to an end fitting.

27. The apparatus of claim 19, wherein the slotted tab may be crimped into a radial groove located on an end fitting.

28. The apparatus of claim 19, further comprising at least one alignment slot located adjacent to each of the at least one or more shaped charge cutouts.

29. The apparatus of claim 19, wherein the slotted tab is crimped using a crimping die.

* * * * *